US006648322B2

(12) United States Patent
Park

(10) Patent No.: US 6,648,322 B2
(45) Date of Patent: Nov. 18, 2003

(54) PAPER FEEDING DEVICE FOR PRINTER

(75) Inventor: Jin-ho Park, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/210,073

(22) Filed: Aug. 2, 2002

(65) Prior Publication Data

US 2003/0075856 A1 Apr. 24, 2003

(30) Foreign Application Priority Data

Oct. 11, 2001 (KR) ..... 2001-62535

(51) Int. Cl.[7] ..... B65H 3/06

(52) U.S. Cl. ..... 271/117; 271/109; 271/114; 271/113; 414/797.3

(58) Field of Search ..... 271/117, 109, 271/114, 113; 414/797.3

(56) References Cited

U.S. PATENT DOCUMENTS 5,547,181 A * 8/1996 Underwood ..... 271/114
6,227,534 B1 * 5/2001 Schoedinger et al. ..... 271/114
6,382,620 B1 * 5/2002 Gaarder et al. ..... 271/117
6,463,255 B1 * 10/2002 Shultz ..... 399/393
2002/0060392 A1 * 5/2002 Underwood et al. ..... 271/109

* cited by examiner

*Primary Examiner*—Donald P. Walsh
*Assistant Examiner*—Kaitlin S Joerger
(74) *Attorney, Agent, or Firm*—Staas & Halsey LLP

(57) ABSTRACT

A paper feeding device for a printer. The device includes a paper feeding cassette to load a plurality of paper sheets, and a driving power source. A driving gear is driven by the driving power source, and a passive gear rotates interlockingly with the driving gear. A first link is provided, with one end pivotally installed on a rotation shaft of the driving gear, and another end coupled to a rotation shaft of the passive gear. A pickup gear rotates interlockingly with the passive gear, and a second link is provided, with one end rotatably installed on the rotation shaft of the passive gear, and with another end coupled to a rotation shaft of the pickup gear. A pickup roller is coaxially coupled to the pickup gear, to simultaneously rotate and press the paper so as to feed the paper sheets one by one into the printer body. A supporting arm is provided, with a first end coupled to a rotation shaft of the pickup roller, and a second end pivotally installed on a side of the printer body. Accordingly, variation of the paper contact angle with respect to the variation of the height of the paper stack is kept to a minimum, and therefore, paper feeding errors are prevented.

31 Claims, 9 Drawing Sheets

(PRIOR ART)

(PRIOR ART)

(PRIOR ART)

PAPER FEEDING DEVICE FOR PRINTER

CROSS-REFERENCE TO RELATED APPLICATIONS

This application claims the benefit of Korean Application No. 2001-62535, filed Oct. 11, 2001, in the Korean Industrial Property Office, the disclosure of which is incorporated herein by reference.

BACKGROUND OF THE INVENTION

1. Field of the Invention

The present invention relates to a paper feeding device for a printer. More specifically, the present invention relates to a paper feeding device for a printer, in which an automatic compensation unit is provided.

2. Description of the Related Art

Generally, a printer is provided with a paper feeding device which is secured on the printer body, for feeding the paper sheets. The printer paper feeding device feeds paper sheets from a paper feeding cassette one by one into a printer body in accordance with printing signals. The paper feeding is achieved by exerting a vertical force on a rubber roller so as to generate a friction force between the paper sheet and the roller.

However, as the paper sheets are fed into the printer body and thus the stack of paper becomes lower, the vertical force varies, thereby varying the friction force as well. This hinders smooth paper feeding, thus the variation of the vertical force must remain within a certain range.

FIG. 1 schematically illustrates the construction of the conventional printer paper feeding device in which an automatic compensation unit is provided to compensate for the vertical forces. FIG. 2 illustrates variations of paper contact angles of the paper feeding device of FIG. 1. That is, FIG. 2 illustrates an angle between an uppermost paper sheet of the paper stack at maximum height and the automatic compensation unit, and an angle between the lowermost paper sheet and the automatic compensation unit. Referring to FIGS. 1 and 2, the paper contact angles are varied from an angle β1 (when the paper stack is at maximum height) to an angle β2 (when only the last paper is left).

As shown in FIG. 1, the printer paper feeding device includes a pickup shaft 11 for transmitting the rotation torque of a driving source (not illustrated), an automatic compensation unit 10 provided with a pickup roller 15, a paper feeding cassette 20 for accommodating a paper stack 30, and a separating wall 23 formed on one end of the paper feeding cassette 20 in a paper-feeding direction, for separating the paper sheets.

The automatic compensation unit 10 comprises a train of four gears 13*a*, 13*b*, 13*c* and 13*d*. The train of four gears 13*a*, 13*b*, 13*c* and 13*d* are pivotally connected to the pickup shaft 11 so that the first gear 13*a* can transmit the rotation torque T of the pickup shaft 11 to the pickup roller 15, and the pickup roller 15 can vary its contact position on the paper stack 30 as the height of the paper stack 30 is decreased during the printing operation. The pickup roller 15 is coupled coaxially to a shaft of the 4th gear 13*d* by being interlocked to the pickup shaft 11.

The operation of the printer paper feeding device will now be described. When the pickup shaft 11 is rotated by the driving source (not illustrated), then the first gear 13*a* rotates, and the second and third gears 13*b* and 13*c* rotate so as to ultimately transmit the power to the fourth gear 13*d*.

The pickup roller 15 is assembled to the shaft of the fourth gear 13*d*, and therefore, if the fourth gear 13*d* rotates, then the pickup roller 15 also rotates. If the pickup roller 15 rotates, the uppermost sheets of paper of the cassette 20 are biased forward due to the friction force between the pickup roller 15 and the paper stack 30. Then, due to the presence of the separating wall 23, only the uppermost sheet of paper is separated and fed into the printer body.

If the paper sheets are to be separated one by one, the following conditions must be satisfied:

$$F_{pick}>F_{fric}>F_d>F_{double} \quad \text{<Formula 1>}$$

where $F_{pick}$ is the feeding force due to the rotation torque of the pickup roller 15, $F_{fric}$ is the carrying force due to the friction between the pickup roller 15 and the paper stack 30, $F_d$ is the resistant force acting on the leading edge of the paper by the separating wall 23 and $F_{double}$ is the carrying force for the second sheet paper next to the uppermost paper sheet.

First, $F_{pick}$ is calculated as follows:

$$F_{pick}=T/r \quad \text{<Formula 2>}$$

where T is the rotation torque of the pickup shaft 11 and r is the radius of the pickup roller 15, $F_{fric}$ is calculated as follows:

$$F_{fric}=\mu_{roll}\times N_{total} \quad \text{<Formula 3>}$$

where $\mu_{roll}$ is the friction coefficient between the paper stack 30 and the pickup roller 15 and $N_{total}$ is the maximum vertical force pressing on the paper stack 30 by the pickup roller 15.

Finally, $F_{double}$ is calculated as follows:

$$F_{double}=\mu_{paper}\times N_{total} \quad \text{<Formula 4>}$$

where $\mu_{paper}$ is the friction coefficient between the paper sheets, and $N_{total}$ is the maximum vertical force pressing on the paper stack 30 by the pickup roller 15.

As shown in Formulas 2 through 4, if factors such as the rotation torque T of the pickup shaft 11, the radius r of the pickup roller 15, the separating wall 23 and the type of paper sheet are properly chosen, then $F_{pick}$ and $F_d$ become constant regardless of a height h of the paper stack 30, and therefore, the height h is constant. However, $F_{fric}$ and $F_{double}$ vary in accordance with the height of the paper stack 30, and therefore, $F_{fric}$ and $F_{double}$ are treated as variables. Accordingly, whether Formula 1 is satisfied or not is determined by the value of $N_{total}$.

$N_{total}$ is the vertical force pressing on the paper stack 30 by the pickup roller 15, and therefore, it can be expressed as the vertical force acting on the pickup roller 15. $N_{total}$ is the sum total of: a vertical force $N_R$ due to the rotation torque of the pickup roller 15, a vertical force $N_A$ due to a link 12 of the automatic compensation unit 10, and a vertical force $N_W$ due to the weight of the automatic compensation unit 10.

$$N_{total}=N_R+N_A+N_W \quad \text{<Formula 5>}$$

In the above formula, the vertical force $N_R$ acts such that the rotation torque of the pickup roller 15 increases the vertical force $N_R$ at the instant when $F_d>F_{fric}$ so as to stop the feeding of the paper sheets. Referring to FIG. 3A, a maximum value of the vertical force $N_R$ is calculated by the following formula.

$$N_R = \frac{T}{r} \cdot \cos\beta \cdot \sin\beta \quad \text{<Formula 6>}$$

where T is the rotation torque of the pickup roller 15, r is the radius of the pickup roller 15, and β is the paper contact angle.

Further, the vertical force $N_A$ due to the action of the link 12 of the automatic compensation unit is generated when the carrying force $F_{fric}$ due to the pickup roller 15 attains equilibrium with the paper feed resistance $F_d$ to stop the rotation of the pickup roller 15. A maximum value of the vertical force $N_A$ is calculated based on the following formula by referring to FIG. 3B.

$$N_A = \frac{T}{L} \cdot \cos\beta \quad \text{<Formula 7>}$$

where L is the length of the link 12 of the automatic compensation unit 10, T is the rotation torque of the pickup roller 15, and β is the paper contact angle.

The vertical force $N_W$ due to the weight of the automatic compensation unit 10 is calculated based on the following formula by referring to FIG. 3C.

$$N_W = W \cdot \frac{D}{L} \quad \text{<Formula 8>}$$

where W is the total weight of the automatic compensation unit 10, D is the distance from the center of the first gear 13*a* to the center of gravity of the automatic compensation unit 10, and L is the length of the link 12 of the automatic compensation unit 10.

Accordingly, if Formulas 6 through 8 are substituted into Formula 5, then Formula 5 can be expressed as follows:

$$N_{total} = \frac{T}{r} \cdot \sin\beta \cdot \cos\beta + \frac{T}{L} \cdot \cos\beta + W \cdot \frac{D}{L} \quad \text{<Formula 9>}$$

$N_{total}$ is the maximum vertical force acting on the pickup roller 15 during the generation of the feed resistance $F_d$, and this force acts until the conditions of Formula 1 are satisfied. However, in the normal paper feeding operation, the paper sheet advances before the vertical force acts. If the carrying force $F_{fric}$ does not exceed the paper feed resistance $F_d$, then $N_R$, and $N_A$ automatically and gradually increase the vertical force $N_{total}$. Thus, if the vertical force increases, the carrying force $F_{fric}$ due to friction increases according to Formula 3, with the result that the conditions of Formula 1 are satisfied, thereby allowing the paper sheet to advance.

If the ratio of the radius r of the pickup roller 15 to the length L of the link 12 is 1:5, based on Formula 9, then the relationship between the paper contact angle β and the vertical force $N_{total}$ is illustrated in FIG. 4. The maximum value is seen near a β value of 45 degrees.

If the uppermost paper sheet is to be fed, a proper force between the carrying force $F_{fric}$ of the first paper and the forward biasing force $F_{double}$ of the second paper must be selected such that the resistant force $F_d$ would be a factor. However, as the paper is fed and thereby gradually the height h of the paper stack 30 lowers, then the paper contact angle β is gradually varied. Specifically, as shown in FIG. 2, the paper contact angle β varies from the angle β1 to the angle β2.

A variation amount Δθ (β2-β1) of the paper contact angle is proportional to: (1) the paper stacking height h; (2) the length L of the link 12; and (3) the initial paper contact angle β 1 or β 2.

Referring to FIG. 2, when β 2 is varied from 0° to 90°, the variation amount Δθ is greatly varied. Specifically, from $$\sin^{-1}\left(\frac{h}{L}\right) \text{ to } \cos^{-1}\left(\frac{L-h}{L}\right).$$

In order to avoid such a large variation, β2 is generally between 7° and 15°, However, within this paper contact angle range, a steep variation of the vertical force $N_{total}$ occurs between β 1 and β 2, as shown in the graph of FIG. 4. If the maximum amount of paper is loaded in the paper cassette 20, a great difference in the vertical force $N_{total}$ occurs between the first paper and the last paper. Therefore, instances in which Formula 1 cannot be satisfied are likely. Specifically, when the variation between $F_{fric}$ and $F_{double}$ cannot satisfy Formula 1, a feed failure or a double feed occurs.

Furthermore, the paper feed resistance $F_d$ is different depending on the type and the stiffness of the paper. Therefore, if all types of paper are to satisfy Formula 1, then the variation range between $F_{fric}$ and $F_{double}$ must be as small as possible.

SUMMARY OF THE INVENTION

Accordingly, it is an object of the present invention to overcome the above described disadvantages of the conventional techniques.

Accordingly, it is another object of the present invention to provide a paper feeding device for a printer, in which a variation amount of a vertical force is kept to a minimum so as to prevent feeding errors, even when using various kinds of printing media.

Additional objects and advantages of the invention will be set forth in part in the description which follows and, in part, will be obvious from the description, or may be learned by practice of the invention.

The foregoing and other objects of the present invention are achieved by providing a paper feeding device for a printer including a paper feeding cassette to load a plurality of paper sheets; a driving power source; a driving gear driven by the driving power source; a passive gear rotated interlockingly with the driving gear; a first link having a first end pivotally installed on a rotation shaft of the driving gear, and a second end coupled to a rotation shaft of the passive gear; a pickup gear rotated interlockingly with the passive gear; a second link having a first end rotatably installed on the rotation shaft of the passive gear, and a second end coupled to a rotation shaft of the pickup gear; a pickup roller coaxially coupled to the pickup gear, to simultaneously rotate and press the paper sheets so as to feed the sheets one by one into a printer body; and a supporting arm with a first end coupled to a rotation shaft of the pickup roller, and with a second end pivotally installed on a side of the printer body.

Furthermore, a connecting gear is disposed between the driving gear and the passive gear, to transmit a rotation torque of the driving gear to the passive gear and an idler gear is disposed between the passive gear and the pickup gear, to transmit a rotation torque of the passive gear to the pickup gear.

Furthermore, the pickup gear, the connecting gears, the passive gear, the idler gear and the pickup gear have the same shape.

Furthermore, there is included a separating wall installed on an end of the paper feeding cassette, to contact a leading edge of the paper sheets and wherein the separating wall includes a top portion inclined in a paper feeding direction.

In the paper feeding device of the present invention as described above, the paper contact angle is minimized even when the paper sheets are continuously fed, thereby lowering the height of the paper stack. Thus, the variation of the vertical force acting on the pickup roller is minimized, thereby preventing paper-feeding errors, even in the case where various kinds of paper are used.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
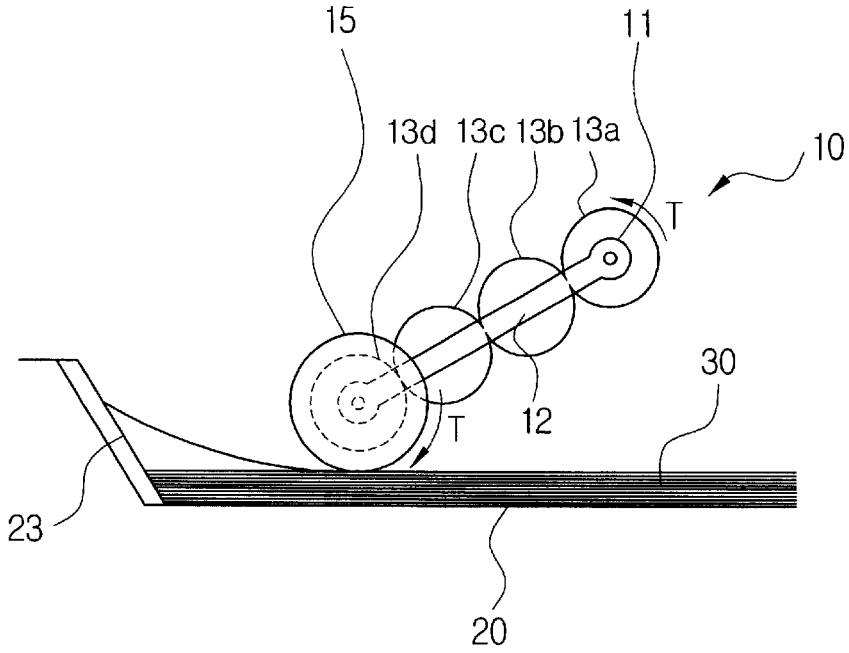
FIG. 1 schematically illustrates a conventional paper feeding device for a printer.
Figure 2:
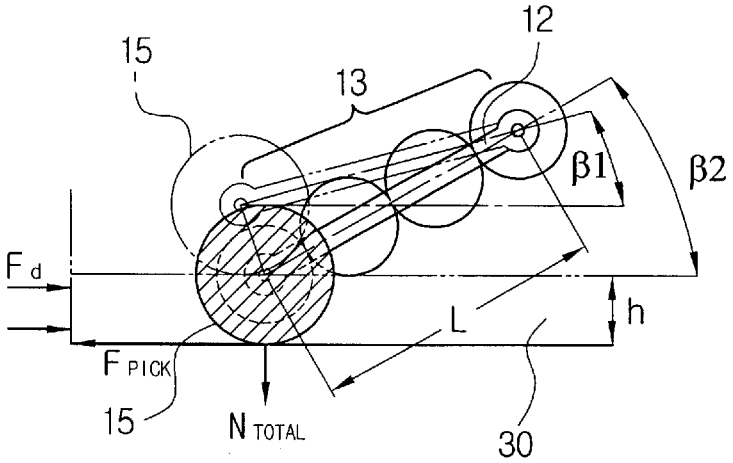
(PRIOR ART) FIG. 2
FIG. 2 illustrates variations of the paper feeding angle in accordance with the variations of height of a paper stack in the conventional paper feeding device.
Figure 3A:
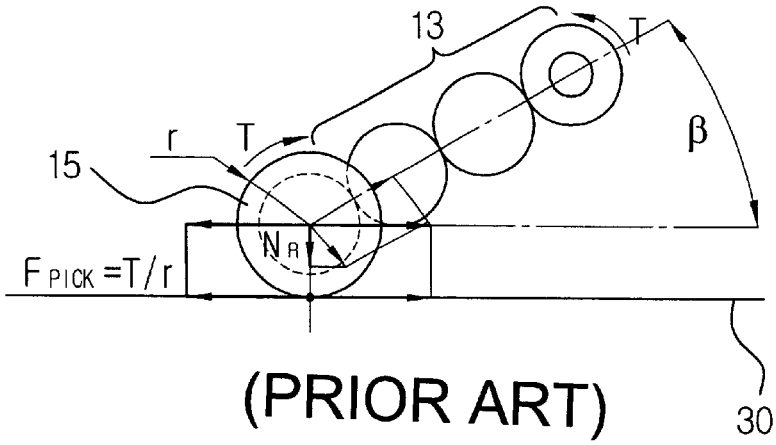
FIG. 3A illustrates the vertical force acting on the pickup roller by the rotation torque of the pickup roller in the conventional paper feeding device.
Figure 3B:
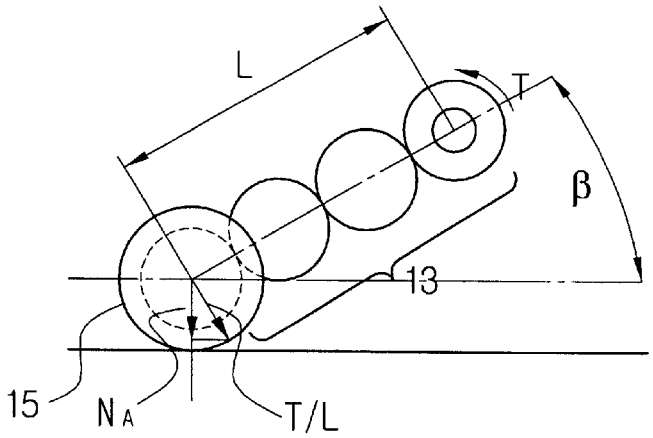
(PRIOR ART) FIG.3B
FIG. 3B illustrates the vertical force acting on the pickup roller by the link of the automatic compensation unit in the conventional paper feeding device.
Figure 3C:
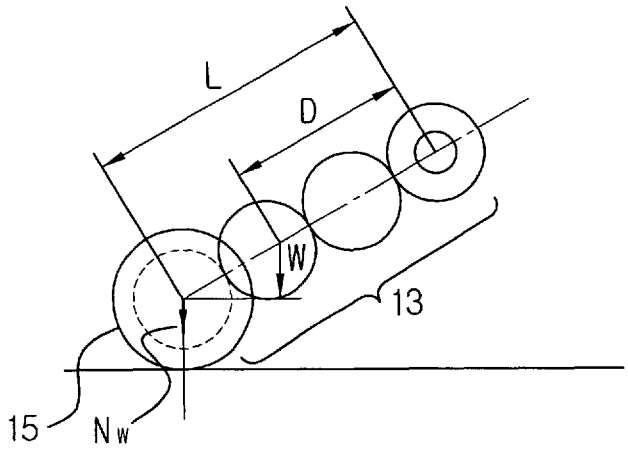
FIG. 3C illustrates the vertical force acting on the pickup roller by the weight of the automatic compensation unit in the conventional paper feeding device.

Reference will now be made in detail to the present preferred embodiments of the present invention, examples of which are illustrated in the accompanying drawings, wherein like reference numerals refer to like elements throughout.

Figure 5:
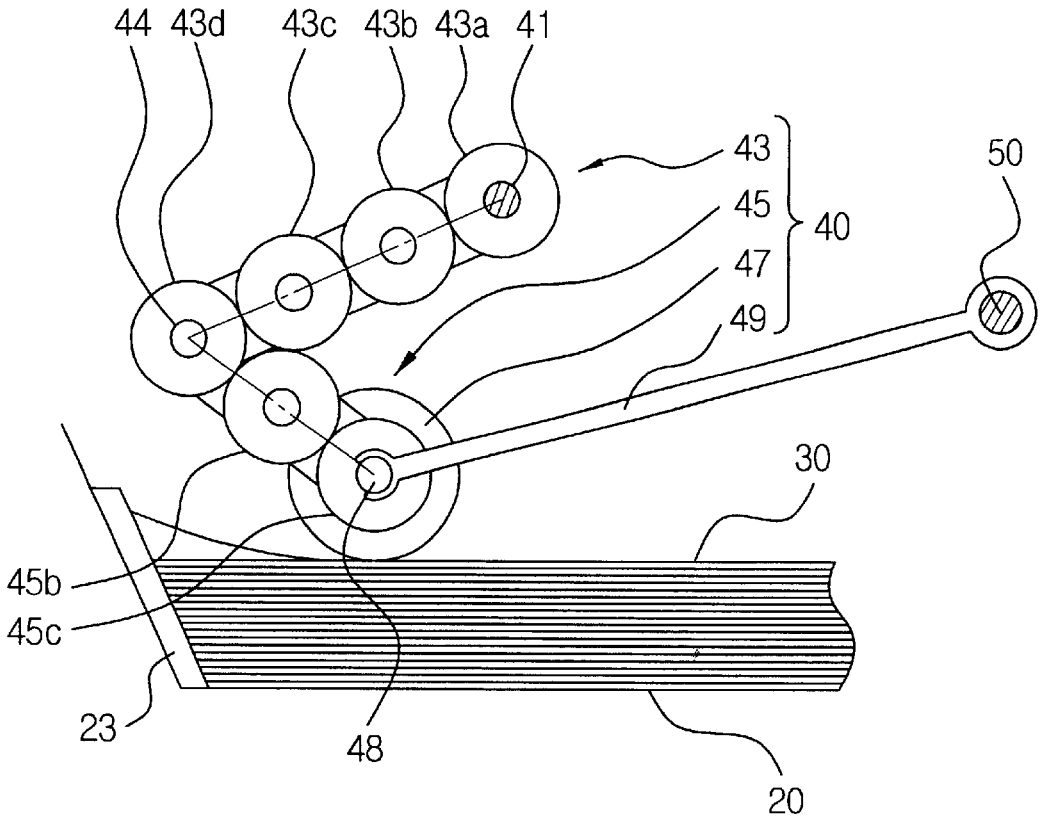
FIG. 5 is a front view of the paper feeding device for a printer according to an embodiment of the present invention.
Figure 6:
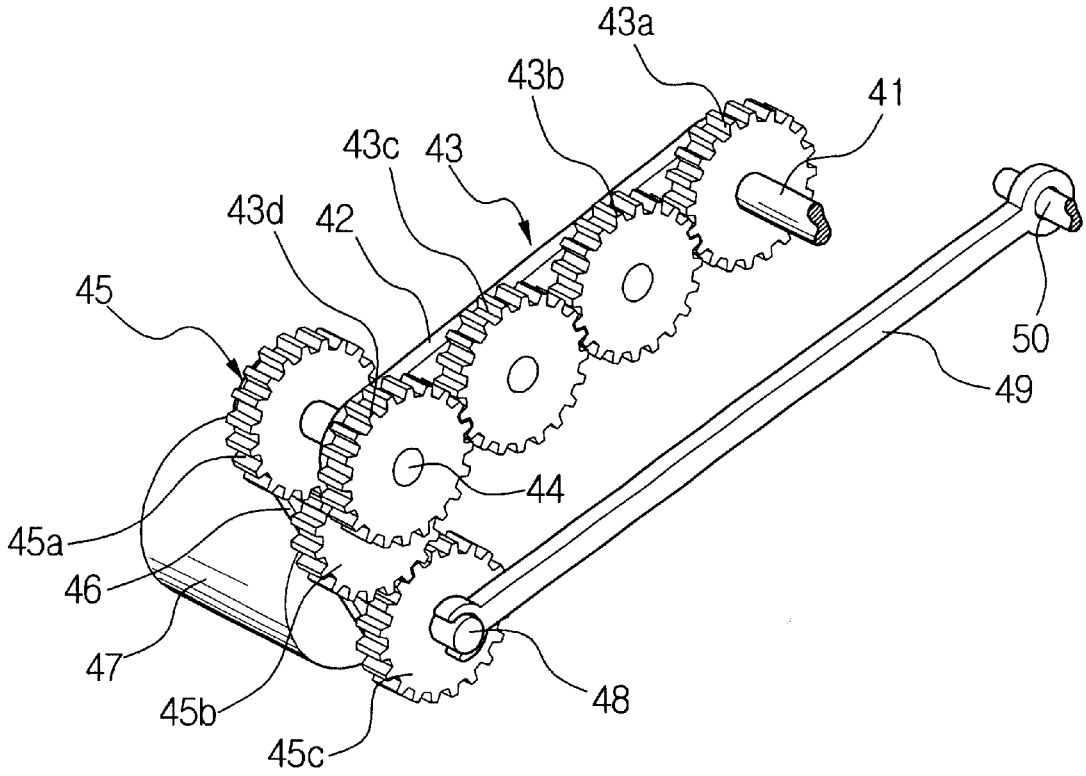
FIG. 6 is a perspective view of the automatic compensation unit of the paper feeding device for the printer shown in FIG. 5.

Referring to FIGS. 5 and 6, the paper feeding device for a printer according to an embodiment of the present invention includes an automatic compensation unit 40 including a first link assembly 43, a second link assembly 45, a pickup roller 47, a supporting arm 49, and a paper feeding cassette 20.

The first link assembly 43 includes of a gear train including four gears 43*a,* 43*b,* 43*c* and 43*d,* which are linked on a first link. Driving gear 43*a* of one end is coupled to a pickup shaft 41, and therefore, the driving gear 43*a* rotates if the pickup shaft 41 rotates. Thus, the rotation torque is transmitted through first and second connecting gears 43*b* and 43*c* to the passive gear 43*d.*

In the present example, there are two connecting gears 43*b* and 43*c* in the first link assembly 43. However, the number of the connecting gears is not limited to two, but may vary depending on the size of the printer.

The pickup shaft 41 is connected to a driving power source (not shown) of the printer body, to transmit the driving power to the driving gear 43*a.* A first link 42 is pivotally installed on the pickup shaft 41, and therefore, if the paper sheets are continuously fed to lower the height of the paper stack 30, then the first link 42 is pivoted downward on the pickup shaft 41.

The second link assembly 45 includes a gear train including three gears 45*a,* 45*b* and 45*c* of the same shape and connected to a second link 46. Auxiliary driving gear 45*a* is installed on a passive gear shaft 44 of the passive gear 43*d* of the first link assembly 43, and is separated from the passive gear 43*d* by a certain distance and is installed coaxially with the passive gear 43*d.* Accordingly, if the passive gear 43*d* of the first link assembly 43 rotates, then the rotational power is transmitted through the auxiliary driving gear 45*a,* and the idler gear 45*b* of the second link assembly 45 to the pickup gear 45*c.*

The second link 46 is pivotally connected to the passive gear shaft 44 of the first link assembly 43, and pivots downward on the passive gear shaft 44 similar to the first link 42, if the height h of the paper stack 30 is lowered.

In the present invention, the second link assembly 45 includes one idler gear 45*b.* However, as in the first link assembly 43, the number of the idler gears may vary in accordance with the size of the printer.

The pickup roller 47 is assembled coaxially with the pickup gear 45*c* of the second link 46, and therefore, if the pickup gear 45*c* of the second link 46 rotates, then the pickup roller 47 also rotates.

One end of the supporting arm 49 is pivotally installed on a side of the printer body around a pivotal shaft 50, while the other end of the supporting arm 49 is pivotally installed to a rotation shaft 48 of the pickup roller.

Accordingly, as the paper sheets are fed into the printer body, and thus, as the height of the paper stack 30 is lowered, the supporting arm 49 pivots downward on the pivoting shaft 50. Furthermore, the pickup roller 47, which is pivotally installed on the other end of the supporting arm 49, is lowered by being pivoted on the pivoting shaft 50. Accordingly, a vertical force of a nearly constant magnitude can be imposed on the paper stack. That is, even if the paper feeding is continued and the height h of the paper stack 30 is lowered gradually, the pickup roller 47 can press continuously on the paper stack 30 due to the cooperated actuations among the first link 42, the second link 46 and the supporting arm 49.

The paper feeding cassette 20 is installed under the pickup roller 47, and is capable of accommodating many sheets of paper. A separating wall 23 is installed on the paper feeding cassette 20 in the feeding direction, and forms an obtuse angle with the bottom face of the paper cassette 20.

As illustrated herein, the power is transmitted through the first and second link assemblies 43 and 45, i.e., through the gear gears 43*a* to 43*d* and 45*a* to 45*c*. However, in an alternative method, the power can be transmitted through a timing pulley and a belt. That is, timing pulleys are used in place of the driving gear 43*a* and the passive gear 43*d*, and the pulleys are connected with a timing belt. For the auxiliary driving gear 45*a* and the pickup gear 45*c*, the same structure can be provided. As a further example, instead of the gears or pulleys, friction wheels may be used to transmit the driving power.

We now describe the operation of the present invention.

First, the pickup shaft 41 rotates by receiving the power from the driving power source (not illustrated), and at the same time, the driving gear 43*a* of the first link assembly 43, which is installed on the pickup shaft 41, rotates. Within the gear train, the driving gear 43*a* transmits the driving power through the first and second connecting gears 43*b* and 43*c* to the passive gear 43*d* to rotate the passive gear 43*d*. Thus, if the passive gear 43*d* rotates, then the auxiliary driving gear 45*a* of the second link assembly 45, which is installed on the shaft 44 coaxially with the passive gear 43*d*, rotates. The rotation of the auxiliary driving gear 45*a* is transmitted through the idler gear 45*b* to the pickup gear 45*c* to drive the pickup gear 45*c*. If the pickup gear 45*c* rotates, then the pickup roller 47, which is installed on the rotation shaft 48 coaxially with the pickup gear 45*c*, rotates.

If the pickup roller 47 rotates, then paper sheets at the upper part of the paper stack 30 of the paper feeding cassette 20 are biased forward due to the friction force between the paper stack 30 and the pickup roller 47. Then, only the uppermost paper is fed into the printer body due to the presence of the separating wall 23. In this situation, if the paper sheets are to be separated one by one, then Formula 1, i.e., $F_{pick}>F_{fric}>F_d>F_{double}$ must be satisfied.

In the above formula, $F_{pick}$ is the paper feeding force due to the rotation of the pickup roller 47, $F_d$ is the resistance of the paper separating wall 23 against the paper, and $F_{double}$ is the carrying force for the second sheet of paper next to the first sheet of paper. However, the paper feeding force $F_{pick}$ and the resistance force $F_d$ are determined by factors such as the rotation torque of the driving power source, the radius of the pickup roller 47, and the stiffness of the paper. Therefore, $F_{pick}$ and $F_d$ are constant even if the height h of the paper stack 30 is lowered. However, the paper carrying force $F_{fric}$ and the second paper carrying force $F_{double}$ act as variables if the vertical force $N_{total}$ to press the paper stack 30 by the pickup roller 47 is varied. Accordingly, in the present invention, in the case where the height of the paper stack is lowered, how the vertical force $N_{total}$ to press the paper by the pickup roller 47 is varied is discussed herein.

The height of the paper stack 30 is gradually lowered as the printing progress. Accordingly, the first link 42 pivots counter-clockwise (as viewed in FIG. 6) about the pickup shaft 41, and the second link 46 pivots clockwise about the passive gear shaft 44, while the supporting arm 49 pivots counter-clockwise about the pivoting shaft 50.

Figure 7A:
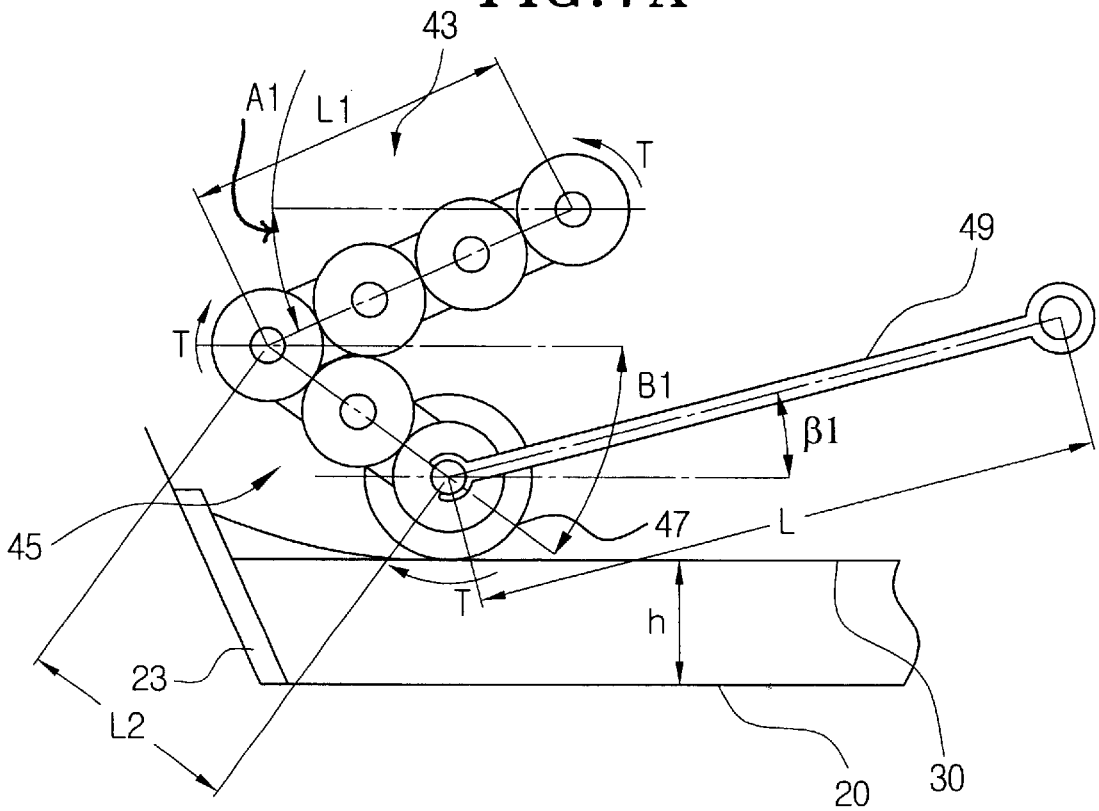
FIG. 7A illustrates the paper contact angle in a case of maximum loading of the paper in the paper cassette in the paper feeding device for the printer shown in FIG. 5.

Referring to FIG. 7A, angle A1 is a first link angle formed between the first link 42 and a plane which passes through the axis of the pickup shaft 41 and is parallel to the bottom of the paper cassette 20. Angle B1 is a second link angle formed between the second link 46 and a plane which passes through the axis of the passive gear shaft 44 and is parallel to the bottom of the paper cassette 20.

Angle β1 is an angle formed between the supporting arm 49 and a plane which passes through the axis of the rotation shaft 48 and is parallel to the bottom of the paper cassette 20. As shown in FIG. 7A, the angle β1 is the initial paper contact angle.

Furthermore, h is the height of paper stack 30 in the case of maximum stacking, and L1 is the length of the first link 42. That is, L1 is the distance between the axis of the driving gear (pickup shaft 41) and the axis of the passive gear shaft 44.

L2 is the length of the second link 46, i.e., the distance between the axis of the passive gear 43*d* (or the driving gear 45*a*) and the axis of the pickup gear 45*c*. L is the length of the supporting arm 49, i.e., the distance between the axis of the pivoting shaft 50 and the axis of the rotation shaft 48. T is the rotation torque which is transmitted from the driving power source.

Figure 7B:
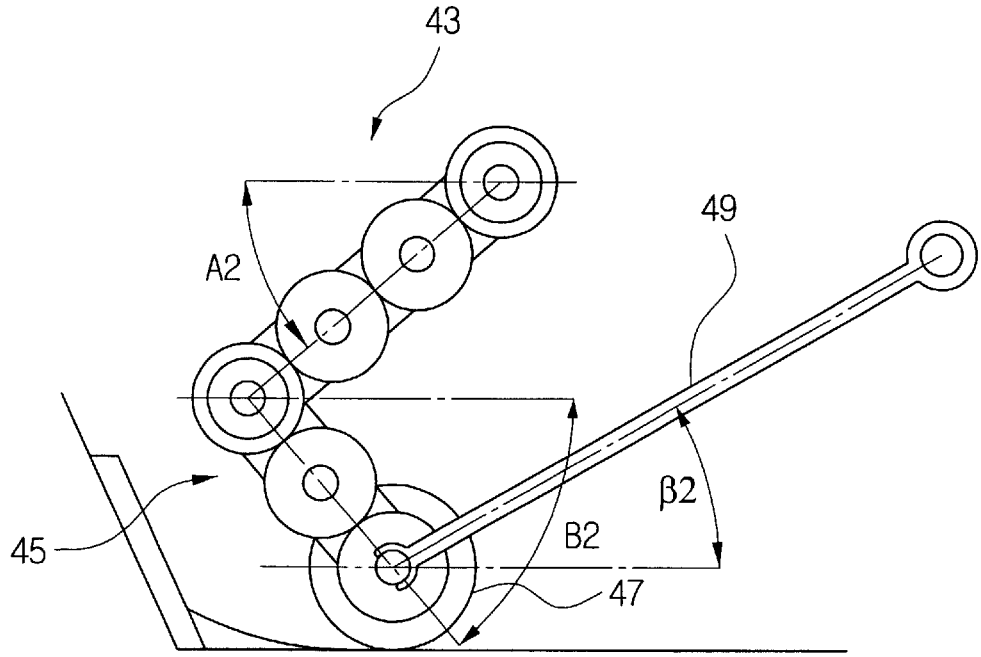
FIG. 7B illustrates the paper contact angle in a case in which the last paper sheet is left in the paper cassette in the paper feeding device for the printer shown in FIG. 5.

Referring to FIG. 7B, the angles A2, B2, β2 respectively correspond to the angles A1, B1, β1 of FIG. 7A. That is, they are the angles formed when the last paper of the paper stack 30 remains to be fed.

In the paper feeding device of the present invention, the vertical force $N_{total}$ acting on the paper stack 30 by the pickup roller 47 can be expressed as follows:

$$N_{total}=N_{L1}+N_{L2}+N_R+N_W \qquad \text{<Formula 10>}$$

where $N_{L1}$ is the vertical force generated by the pivoting of the first link 42, $N_{L2}$ is the vertical force generated by the pivoting of the second link 46, $N_R$ is the vertical force generated by the rotation torque of the pickup roller 47, and $N_W$ is the vertical force generated by the weight of the automatic compensation unit 40.

Figure 8A:
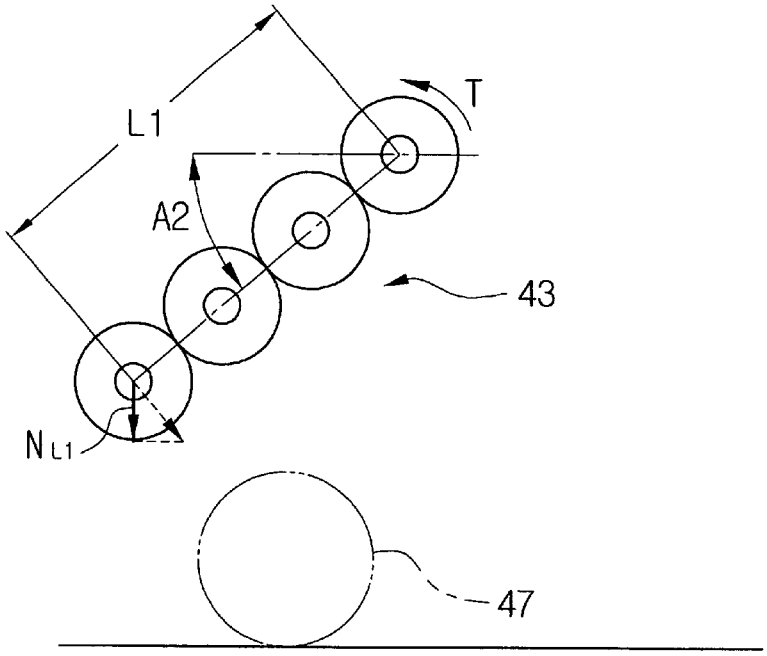
FIG. 8A illustrates the vertical force acting on the pickup roller due to the pivoting of the first link in the paper feeding device for the printer shown in FIG. 5.

First, referring to FIG. 8A, $N_{L1}$ can be calculated by the following formula:

$$N_{L1} = \frac{T}{L1}\cdot\cos(A2) \qquad \text{<Formula 11>}$$

where L1 is the length of the first link 42, T is the rotation torque of the driving power source, and A2 is the first link angle formed between the first link 42 and a plane which passes through the axis of the pickup shaft 41 and is parallel to the bottom of the paper feeding cassette 20.

Figure 8B:
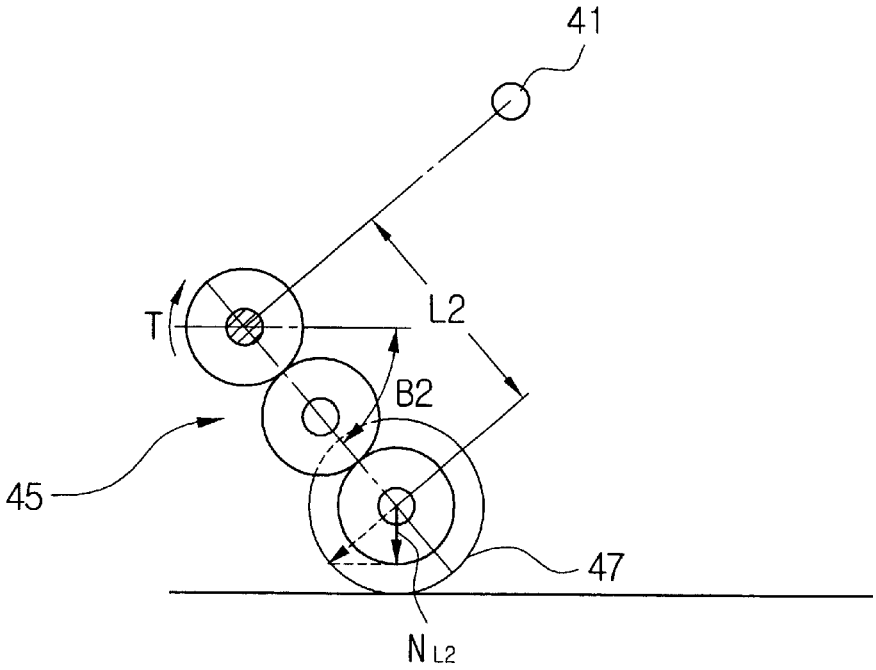
FIG. 8B illustrates the vertical force acting on the pickup roller due to the pivoting of the second link in the paper feeding device for the printer shown in FIG. 5.

The vertical force $N_{L2}$ generated by the pivoting of the second link 46 can be calculated referring to FIG. 8B and is based on the following formula:

$$N_{L2} = \frac{T}{L2}\cdot\cos(B2) \qquad \text{<Formula 12>}$$

where L2 is the length of the second link 46, T is the rotation torque of the driving power source, and B2 is the second link angle formed between the second link 46 and a plane which passes through the axis of the passive gear shaft 44 of the first link 42 and is parallel to the bottom of the paper feeding cassette 20.

Figure 8C:
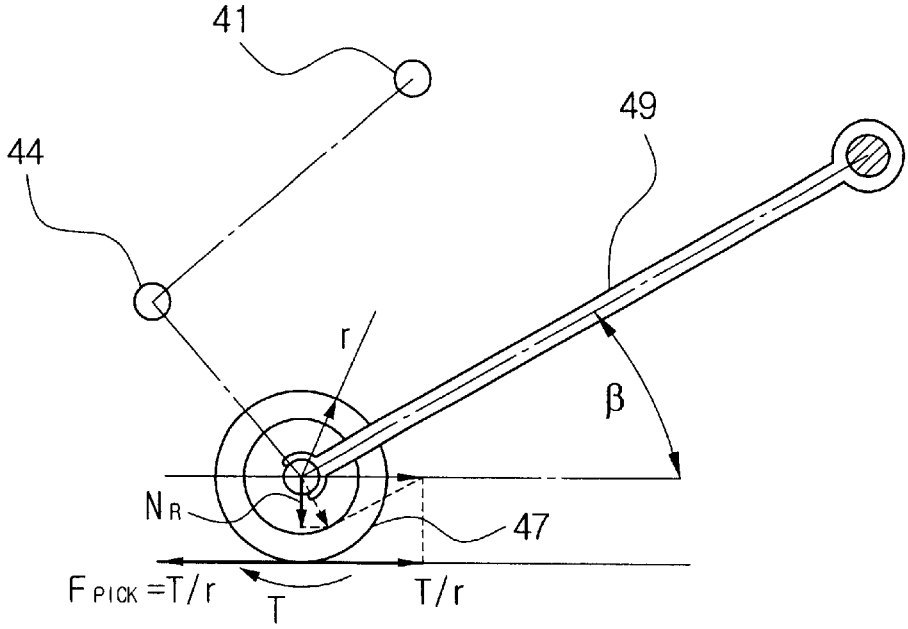
FIG. 8C illustrates the vertical force acting on the pickup roller due to the rotation torque of the pickup roller in the paper feeding device for the printer shown in FIG. 5.

The vertical force $N_R$ generated by the rotation torque of the pickup roller 47 can be calculated referring to FIG. 8C and based on the following formula:

$$N_R = \frac{T}{r}\cdot\sin\beta\cdot\cos\beta \qquad \text{<Formula 13>}$$

where T is the rotation torque of the driving power source, r is the radius of the pickup roller 47, and β is the paper contact angle.

Finally, $N_W$ is the vertical force due to the weight of the automatic compensation unit 40. Here, the automatic compensation unit 40 includes the first link assembly 43, the second link assembly 45, the supporting arm 49 and the pickup roller 47.

Figure 8D:
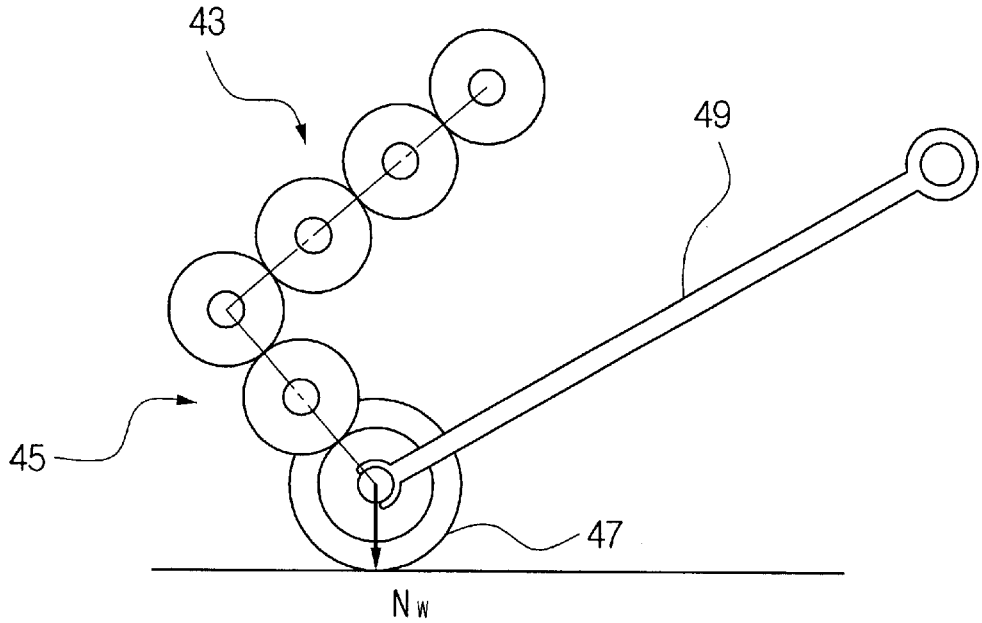
FIG. 8D illustrates the vertical force acting on the pickup roller due to the weight of the automatic compensation unit in the paper feeding device for the printer shown in FIG. 5.

Referring to FIG. 8D, the center of gravity of the automatic compensation unit 40 can be treated as moving approximately vertically in accordance with the variation of the paper contact angle β, and therefore, the vertical force due to the weight of the automatic compensation unit 40 can be treated as a constant.

Accordingly, the variation trend of the vertical force $N_{total}$ which acts on the paper by the pickup roller 47 in accordance with the residue of the paper can be expressed in a simplified form, because the vertical force $N_W$ due to the weight of the automatic compensation unit 40 is almost a constant value.

If the vertical force $N_{total}$ in which the $N_W$ is omitted is indicated by $N_\Sigma$, then $N_\Sigma$ can be expressed as follows:

$$N_\Sigma = T \cdot \left\{ \frac{1}{L1} \cdot \cos(A) + \frac{1}{L2} \cdot \cos(B) + \frac{1}{r} \cdot \cos\beta \cdot \sin\beta \right\} \quad \text{<Formula 14>}$$

where T is the rotation torque of the pickup roller 47, L1 is the length of the first link 42, L2 is the length of the second link 46, r is the radius of the pickup roller 47, A is the first link angle, B is the second link angle, and β is the paper contact angle.

Figure 9:
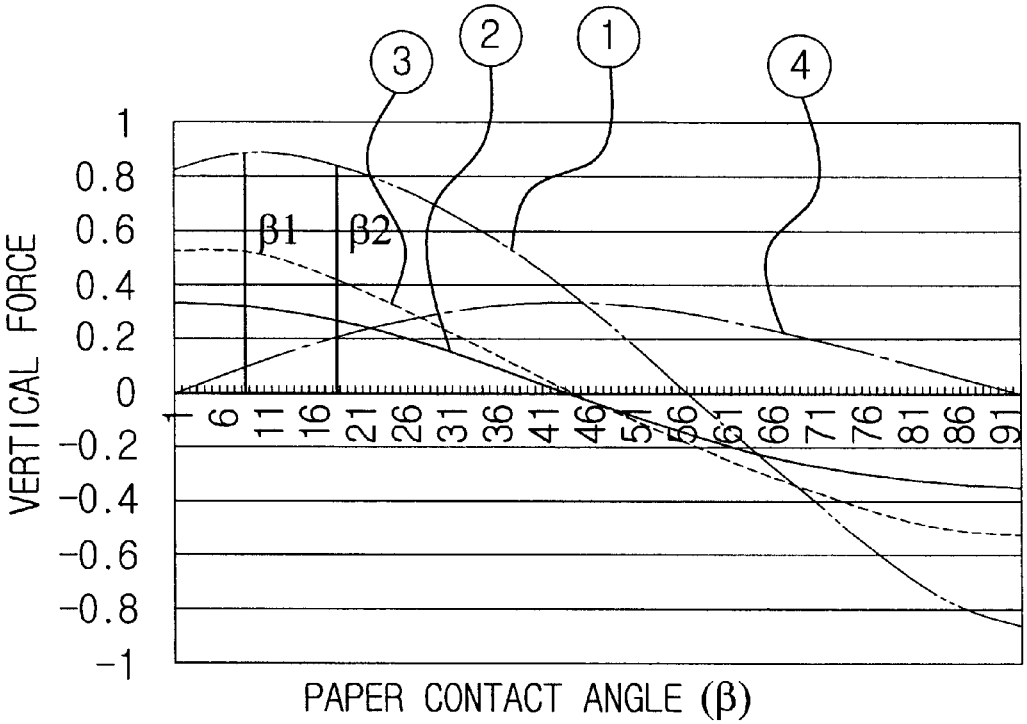
FIG. 9 is a graphical illustration showing the relationship between the vertical force and the paper contact angle in the paper feeding device for the printer shown in FIG. 5.

As shown in FIG. 9, curve ① indicates the variation trend of the vertical force $N_\Sigma$ as a function of variations of the paper contact angle β. Curve ② indicates the variation trend of the vertical force acting on the pickup roller 47 by the first link 42.

Curve ③ indicates the variation trend of the vertical force acting on the pickup roller 47 by the second link 46. Curve ④ indicates the variation trend of the vertical force acting on the pickup roller 47 by the rotation torque of the pickup roller 47. Curve ① is a summation of the curves ②, ③ and ④.

The graph of FIG. 9 is a result obtained as follows. In order to see the variations of the vertical force $N_\Sigma$ in Formula 14, a ratio of L1:L2:r=3:2:1.5 is set. The gears of the first and second link assemblies 43, 45 are identical, and in this manner, the rotation torque T is constant. Thus the graph of FIG. 9 is obtained.

Furthermore, the variation of the paper contact angle β (which is the angle formed between the paper stack 30 and the supporting arm 49) is set to twice the variation amount of the first link angle A or the second link angle B. Referring to the curve ① of FIG. 9, it can be seen that the variation trend of the vertical force $N_\Sigma$ is almost constant within a range of 7° to 15°, which is the range for normal operations.

The constant $N_\Sigma$ values are because variations of the vertical force $N_\Sigma$ with respect to the variation of the paper height are offset between the first link 42, the second link 46 and the supporting arm 49.

Figure 4:
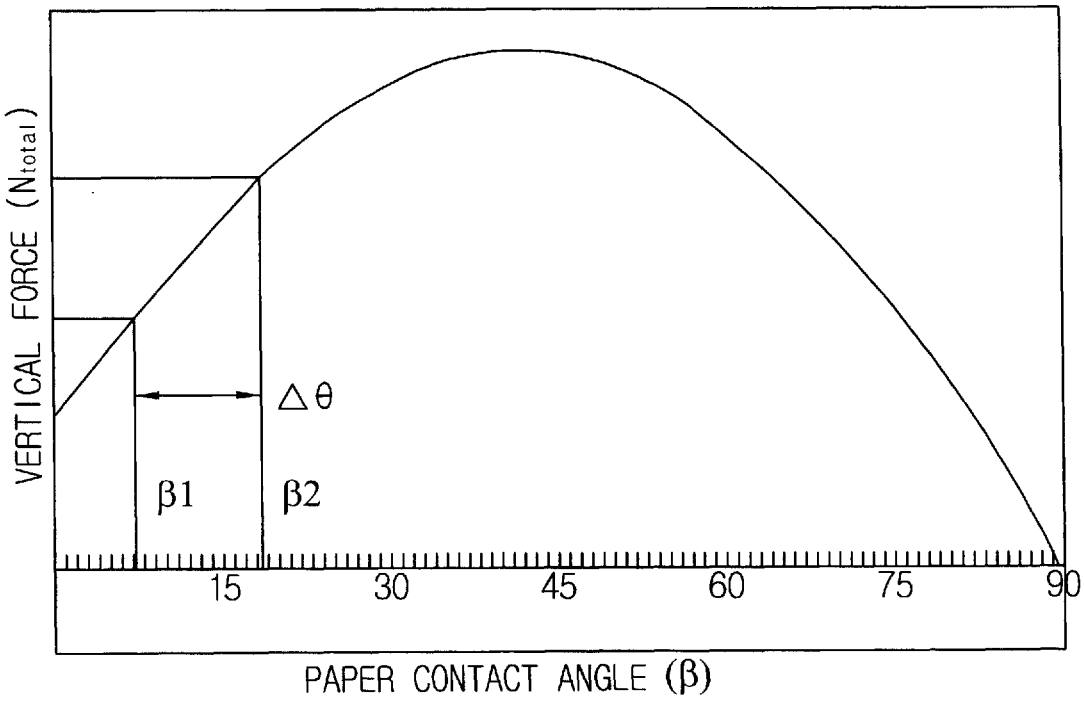
(PRIOR ART) FIG.4
FIG. 4 is a graphical illustration showing the relationship between the vertical force and the variation of the paper contact angle in the conventional paper feeding device.

This is illustrated clearly if FIG. 9 is compared with the graph of FIG. 4. That is, referring to FIG. 4, the difference of the vertical forces $N_{total}$ acting on the pickup roller 15 between β 1 and β 2 is very high, and therefore, sometimes Formula 1 ($F_{pick}>F_{fric}>F_d>F_{double}$) is not satisfied, especially when the paper stack 30 is at maximum height or when only the last sheet remains.

However, referring to the curve ① of FIG. 9, in the paper feeding device of the present invention, when β is varied within the range of 7° to 15°, the vertical force $N_\Sigma$ acting on the pickup roller 47 is almost uniform. Accordingly, Formula 1, i.e., $F_{pick}>F_{fric}>F_d>F_{double}$ can be satisfied throughout the printing operation.

Furthermore, the variation amounts of $F_{fric}$ and $F_{double}$ are very small, and therefore, various sizes of paper can be used, still satisfying the Formula 1. According to the present invention as described above, the variation of the paper contact angle β with respect to the variation of the paper height is maintained at a minimum, and therefore, the variation of the vertical force acting on the pickup roller is minimized, thereby preventing the feeding errors. Also, various sizes of paper can be used, while the paper feeding errors are kept at a minimum.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A paper feeding device for a printer, comprising:

a paper feeding cassette to load a plurality of paper sheets;

a driving power source;

a driving gear having a rotation shaft and driven by the driving power source;

a passive gear having a rotation shaft and rotated interlockingly with the driving gear;

a first link having a first end pivotally installed on the rotation shaft of the driving gear, and a second end coupled to the rotation shaft of the passive gear;

a pickup gear rotated interlockingly with the passive gear;

a second link having a first end rotatably installed on the rotation shaft of the passive gear, and a second end coupled to a rotation shaft of the pickup gear;

a pickup roller having a rotation shaft and coaxially coupled to the pickup gear, to simultaneously rotate and press the paper sheets to feed the paper sheets one by one into a printer body; and a supporting arm having a first end coupled to the rotation shaft of the pickup roller, and a second end pivotally installed on a side of the printer body.

2. The paper feeding device as claimed in claim 1, further comprising a connecting gear disposed between the driving gear and the passive gear, to transmit a rotation torque of the driving gear to the passive gear.

3. The paper feeding device as claimed in claim 2, further comprising a plurality of the connecting gears.

4. The paper feeding device as claimed in claim 3, further comprising an idler gear disposed between the passive gear and the pickup gear, to transmit a rotation torque of the passive gear to the pickup gear.

5. The paper feeding device as claimed in claim 4, wherein the first link and the second link form an angle having the passive gear as a vertex.

6. The paper feeding device as claimed in claim 4, wherein the pickup gear, the connecting gears, the passive gear, and the idler gear have a same shape.

7. The paper feeding device as claimed in claim 4, wherein the first link has a length longer than a length of the second link.

8. The paper feeding device as claimed in claim 7, wherein the pickup roller has a radius smaller than the length of the second link.

9. The paper feeding device as claimed in claim 4, wherein a length of the first link, a length of the second link and a radius of the pickup roller have a ratio of 3:2:1.5.

10. The paper feeding device as claimed in claim 9, wherein a vertical force acting on the paper sheets by the pickup roller is calculated by the following formula:

$$N_{\Sigma} = T \cdot \left\{ \frac{1}{L1} \cdot \cos(A) + \frac{1}{L2} \cdot \cos(B) + \frac{1}{r} \cdot \cos\beta \cdot \sin\beta \right\}$$

where $N_{\Sigma}$ is the vertical force acting on the paper sheets by the pickup roller, T is a rotation torque of the pickup roller, L1 is the length of the first link, L2 is the length of the second link, r is the radius of the pickup roller, A is a first link angle formed between the paper sheets and the first link, B is a second link angle formed between the paper sheets and the second link, and β is a paper contact angle.

11. The paper feeding device as claimed in claim 10, wherein a variation of the paper contact angle is twice a variation of the first link angle or the second link angle.

12. The paper feeding device as claimed in claim 11, wherein the variation of the paper contact angle is between 7° and 15°.

13. The paper feeding device as claimed in claim 1, further comprising a separating wall installed on an end of the paper feeding cassette, to contact a leading edge of the paper sheets.

14. The paper feeding device as claimed in claim 13, wherein the separating wall comprises a top portion inclined in a paper feeding direction.

15. The paper feeding device as claimed in claim 1, further comprising an auxiliary driving gear installed coaxially with the passive gear and meshed with the pickup gear.

16. A printer, comprising:

a printer body;

a paper feeding cassette to load a plurality of paper sheets;

a driving power source;

a driving gear having a rotation shaft and driven by the driving power source;

a passive gear having a rotation shaft and rotated interlockingly with the driving gear;

a first link having a first end pivotally installed on the rotation shaft of the driving gear, and a second end coupled to the rotation shaft of the passive gear;

a pickup gear rotated interlockingly with the passive gear;

a second link having a first end rotatably installed on the rotation shaft of the passive gear, and a second end coupled to a rotation shaft of the pickup gear;

a pickup roller having a rotation shaft and coaxially coupled to the pickup gear, to simultaneously rotate and press the paper sheets to feed the paper sheets one by one into the printer body; and a supporting arm having a first end coupled to the rotation shaft of the pickup roller, and a second end pivotally installed on a side of the printer body.

17. The printer as claimed in claim 16, further comprising a separating wall installed on an end of the paper feeding cassette, to contact a leading edge of the paper sheets.

18. The printer as claimed in claim 17, wherein the separating wall comprises a top portion inclined in a paper feeding direction.

19. The paper feeding device as claimed in claim 16, further comprising an auxiliary driving gear installed coaxially with the passive gear and meshed with the pickup gear.

20. A paper feeding device for a printer, comprising:

a first gear having a rotation shaft to rotate in response to a driving torque;

a second gear having a rotation shaft to receive the driving torque from the first gear;

a first link, comprising:

a first end connected to the rotation shaft of the first gear, and a second end connected to the rotation shaft of the second gear;

a third gear having a rotation shaft to receive the driving torque from the second gear;

a second link, comprising:

a first end connected to the rotation shaft of the second gear, and a second end connected to the rotation shaft of the third gear;

a paper unit to contain a plurality of paper sheets; and a roller, having a rotation shaft, connected to the third gear, to rotate and press the paper sheets to feed the paper sheets one by one into a printer body of the printer.

21. The paper feeding device as claimed in claim 20, further comprising:

an arm, comprising:

a first end connected to the rotation shaft of the roller, and a second end connected to the printer body.

22. The paper feeding device as claimed in claim 21, wherein a length of the first link, a length of the second link and a radius of the roller have a ratio of 3:2:1.5.

23. The paper feeding device as claimed in claim 20, wherein the rotation shafts of the second and third gears each comprise an axis, and a variation of a paper contact angle is twice a variation of a first link angle, formed between the first link and a plane which passes through the axis of the third gear rotation shaft and parallel to a bottom of the paper unit, or a second link angle, formed between the second link and a plane which passes through the axis of the second gear rotation shaft and parallel to the bottom of the paper unit.

24. The paper feeding device as claimed in claim 21, further comprising:

a wall installed on an end of the paper unit, to contact the paper sheets.

25. The paper feeding device as claimed in claim 24, wherein $F_{pick}>F_{fric}>F_d>F_{double}$ is satisfied throughout a printing operation, wherein $F_{pick}$ is a feeding force due to a torque of the roller, $F_{fric}$ is a carrying force due to a friction between the roller and the paper sheets, $F_d$ is a resistant force acting on a leading edge of the paper sheets by the wall, and $F_{double}$ is a carrying force of a second paper sheet below an uppermost paper sheet.

26. A printer, comprising:

a printer body;

a first gear having a rotation shaft to rotate in response to a driving torque;

a second gear having a rotation shaft to receive the driving torque from the first gear;

a first link, comprising:

a first end connected to the rotation shaft of the first gear, and a second end connected to the rotation shaft of the second gear;

a third gear having a rotation shaft to receive the driving torque from the second gear;

a second link, comprising:

a first end connected to the rotation shaft of the second gear, and a second end connected to the rotation shaft of the third gear;

a paper unit to contain a plurality of paper sheets; and a roller connected to the third gear, to rotate and press the paper sheets to feed the paper sheets one by one into the printer body.

27. A printer, comprising:

a printer body;

a first link;

a second link pivotally connected to the first link;

a paper unit to contain a plurality of paper sheets;

a wall installed on an end of the paper unit, to contact the paper sheets;

a roller to rotate and press the paper sheets to feed the paper sheets one by one into the printer body; and an arm, pivotally connected to the roller, $F_{pick}>F_{fric}>F_d>F_{double}$ being satisfied throughout a printing operation, wherein $F_{pick}$ is a feeding force due to a torque of the roller, $F_{fric}$ is a carrying force due to a friction between the roller and the paper sheets, $F_d$ is a resistant force acting on a leading edge of the paper sheets by the wall, and $F_{double}$ is a carrying force of a second paper sheet below an uppermost paper sheet.

28. A paper feeding device for a printer, comprising:

a first rotation unit having a rotation shaft to rotate in response to a driving torque;

a second rotation unit having a rotation shaft to receive the driving torque from the first rotation unit;

a first link, comprising:

a first end connected to the rotation shaft of the first rotation unit, and a second end connected to the rotation shaft of the second rotation unit;

a third rotation unit having a rotation shaft to receive the driving torque from the second rotation unit;

a second link, comprising:

a first end connected to the rotation shaft of the second rotation unit, and a second end connected to the rotation shaft of the third rotation unit;

a paper unit to contain a plurality of paper sheets; and a roller connected to the third rotation unit, to rotate and press the paper sheets to feed the paper sheets one by one into a printer body of the printer.

29. The paper feeding device as claimed in claim 28, wherein the first, second and third rotation units comprise gears.

30. The paper feeding device as claimed in claim 28, further comprising a timing belt to connect the first and second rotation units, wherein the first and second rotation units comprise pulleys.

31. The paper feeding device as claimed in claim 28, wherein the first, second and third rotation units comprise friction wheels.

* * * * *